US012747731B2

(12) United States Patent
Simross

(10) Patent No.: US 12,747,731 B2
(45) Date of Patent: Sep. 29, 2026

(54) COMPRESSOR DEVICE WITH COOLING, AND METHOD FOR OPERATING A COMPRESSOR DEVICE

(71) Applicant: KAESER KOMPRESSOREN SE, Coburg (DE)

(72) Inventor: Dirk Simross, Coburg (DE)

(73) Assignee: KAESER KOMPRESSOREN SE, Coburg (DE)

( * ) Notice: Subject to any disclaimer, the term of this patent is extended or adjusted under 35 U.S.C. 154(b) by 0 days.

(21) Appl. No.: 18/980,794

(22) Filed: Dec. 13, 2024

(65) Prior Publication Data

US 2025/0198409 A1 Jun. 19, 2025

(30) Foreign Application Priority Data

Dec. 13, 2023 (DE) ..... 102023135011.0

(51) Int. Cl.
*F04C 29/04* (2006.01)
*F04C 18/16* (2006.01)
*F04C 28/00* (2006.01)

(52) U.S. Cl.
CPC ..... *F04C 29/04* (2013.01); *F04C 18/16* (2013.01); *F04C 28/00* (2013.01); *F04C 2240/30* (2013.01)

(58) Field of Classification Search
CPC . F04B 39/06; F04B 39/064; F01P 3/20; F01P 7/165; F01P 2050/06; F16N 39/02
See application file for complete search history.

(56) References Cited

U.S. PATENT DOCUMENTS

2011/0000227 A1 1/2011 Kamiya
2017/0082119 A1* 3/2017 Schreiber ..... F04D 17/10
2018/0258952 A1* 9/2018 Meeusen ..... H02K 5/203
(Continued)

FOREIGN PATENT DOCUMENTS

AT 307156 B 5/1973
DE 2849286 A1 5/1980
DE 2953216 A1 12/1980
(Continued)

OTHER PUBLICATIONS

European Patent Office Action for Application No. 24218453.9 dated Jul. 22, 2025 (17 pages including statement of relevance).

*Primary Examiner* — Anthony Ayala Delgado
(74) *Attorney, Agent, or Firm* — MICHAEL BEST & FRIEDRICH LLP

(57) ABSTRACT

A compressor device includes a compressor for compressing a gas to generate a compressed gas having at least one compressor stage, and a cooling device including an oil cooler for cooling oil heated by the compressor, a compressed gas cooler for cooling the gas that is completely or partially compressed to form the compressed gas, and a housing cooler for cooling a housing or part of the housing of the compressor. The oil cooler, the compressed gas cooler, and the housing cooler each achieve cooling by a coolant flow consisting of a liquid coolant. The compressor device further includes a housing cooler control means for individually controlling the cooling flow through the housing cooler, and a cooling control configured to actuate the housing cooler control means in such a way that the coolant flow is controlled by the housing cooler independently of the cooling flow through the oil cooler.

16 Claims, 5 Drawing Sheets

(56) References Cited

U.S. PATENT DOCUMENTS

| | | | |
|---|---|---|---|
| 2022/0163027 | A1 | 5/2022 | Matsuzaka et al. |

FOREIGN PATENT DOCUMENTS

| | | | |
|---|---|---|---|
| DE | 4104093 | A1 | 8/1992 |
| DE | 10065003 | A1 | 7/2002 |
| DE | 10117790 | A1 | 10/2002 |
| DE | 10156179 | A1 | 5/2003 |
| DE | 102021121424 | A1 | 2/2023 |
| JP | H09158870 | A | 6/1997 |
| WO | 2022163079 | A1 | 8/2022 |

* cited by examiner

COMPRESSOR DEVICE WITH COOLING, AND METHOD FOR OPERATING A COMPRESSOR DEVICE

CROSS-REFERENCE TO RELATED APPLICATIONS

This application claims priority to German Patent Application No. 102023135011.0 filed on Dec. 13, 2023, the entire contents of which are incorporated herein by reference.

The present invention relates to a compressor device for compressing a gas for generating compressed gas, in particular compressed air, wherein the compressor device has a cooling device. In addition, the present invention relates to a method for operating a compressor device having a cooling device.

Compressors for compressing a gas for generating compressed gas may also be referred to as compressed gas compressors. They are therefore used to generate the compressed gas, often in particular compressed air. This compressed air, or other compressed gas, is provided particularly for subsequent industrial use. The following explanations regarding compressed air also apply analogously to other compressed gases.

For functional reasons, heat arises during the generation of compressed air. Both the compressed air and the compressor, in particular its housing, are heated and therefore have to be cooled. For the cooling, housing coolers may be provided for cooling a housing of the compressor or part thereof, said housing coolers frequently also being referred to or designed as jacket coolers. In the case of said coolers, a cooling medium, which may also be synonymously referred to as a coolant, in particular water, can flow through the housing cooler and thereby cool the housing.

In addition, a compressed gas cooler which is arranged in a part of a line system which carries the compressed gas, in particular the compressed air, may be provided. Here, in particular a heat exchanger, through which a cooling medium or coolant, in particular water, likewise flows, can be provided. Oil is frequently also required for the generation of the compressed gas, in particular to lubricate the compressor components. Such oil is also heated and can be cooled by an oil cooler, which may in particular comprise a heat exchanger. A cooling medium or coolant, in particular water, also flows through said heat exchanger.

Efficient cooling can be achieved by the fact that all of the coolers mentioned, with it also being possible in each case for a plurality of said coolers to be provided, are connected to a primary cooling circuit. In particular, the cooling systems can be connected completely or partially in parallel for this purpose, and therefore, as far as possible, a cooler does not receive the previously heated water of a previous cooler, as would happen in a series connection.

The parallel connection means that the individual coolers receive their cooling water content depending on the flow resistance in their parallel branch. By means of an appropriate design of said parallel branches or the coolers as such, the coolers each receive an appropriate amount of coolant, i.e. in particular water.

However, it has turned out that the cooling requirement and thus the demand for coolant, i.e. cooling water, may fluctuate. In order to satisfy this, the flow rate of the coolant in the primary circuit can be adjusted accordingly. However, if the change in the coolant demand in the individual coolers differs, optimum cooling in one cooler may result in excessively strong or excessively weak cooling in another cooler.

In order to adjust such a non-optimum cooling, corresponding valves which are used to manually set the respective coolant inflow of the individual cooling systems can be provided and adjusted. However, such an adjustment may be time-consuming, because a fitter has to make or change corresponding settings to this end. The result also depends on the individual capabilities of the fitter.

A further improvement could be to provide an individual cooling system, in which each cooler receives a dedicated cooling circuit. However, such a solution is complex and therefore not necessarily to be recommended.

Document WO2022163079A1 discloses a cooling system for compressors, in which, inter alia, the quantity of cooling liquid can be adjusted.

It is therefore the object of the present invention to address at least one of the above-mentioned problems. In particular, it is intended to propose a solution in which an adjusted cooling system for a compressor device having a cooling device is created in a simple manner. At the very least, an alternative solution to previously known solutions is intended to be proposed.

According to the invention, a compressor device according to claim 1 is proposed.

Thus, a compressor device is proposed, having a compressor for compressing a gas for generating compressed gas, in particular compressed air, wherein the compressor has at least one compressor stage, and having a cooling device. The cooling device comprises an oil cooler for cooling oil heated by the compressor, at least one compressed gas cooler for cooling the gas that is completely or partially compressed to form the compressed gas, and at least one housing cooler for cooling a housing or part of the housing of the compressor. The oil cooler, the at least one compressed gas cooler and the at least one housing cooler are each set up to achieve cooling by means of a coolant flow consisting of a liquid coolant, in particular water.

At least one housing cooler control means for individually controlling the cooling flow through the housing cooler is provided for the at least one housing cooler. In addition, the compressor device has a cooling control which is designed to actuate the at least one housing cooler control means in such a way that the at least one cooling flow is controlled by the at least one housing cooler independently of the cooling flow through the oil cooler.

Thus, a compressor device having a compressor and a cooling device is provided. The compressor, which may also be synonymously referred to as a compressed gas compressor, is provided for compressing a gas for generating compressed gas. In particular, a compressed air compressor for generating compressed air is proposed. Said compressed air compressor generates compressed gas or compressed air in a generally known way.

In addition, a cooling device which has at least one oil cooler, a compressed gas cooler and a housing cooler is provided. The oil cooler is provided for cooling oil heated by the compressor. For this purpose, the oil can flow from the compressor through a heat exchanger, in which it outputs its heat to a liquid coolant, in particular water, i.e. cooling water.

The compressed gas cooler, of which a plurality may also be provided, is provided for cooling the compressed gas. For this purpose, the compressed gas flows through said compressed gas cooler and outputs heat to a liquid coolant. It is also possible for a compressor to have a plurality of compression stages, and therefore, after the first compression stage, the gas is brought to a first pressure level, enabling it also to already be considered to be a compressed gas. In this respect, however, the compressed gas is not yet compressed to the final pressure level, and therefore it can be assumed that the gas is partially compressed. However, even for this partially compressed gas, which may also already be referred to in simplified form as a compressed gas, as stated, it is possible to provide a compressed gas cooler which in this case can be arranged between two compressor stages. If there are at least two compressor stages, after the second compressor stage at least one compressed gas cooler can be provided again, which cools the compressed gas, which is output from said second compressor stage.

The housing cooler, of which a plurality may also be provided, is provided for cooling a housing or a part of the housing of the compressor. The entire physical configuration of the compressor, or of the part thereof, can be basically considered here to be the housing of the compressor. Therefore, it is not just a housing in the sense of covering the compressor, but the compressor is involved as a physical object. A housing cooler may also include or denote coolant channels in the housing of a compressor stage of a compressor.

With regard to these coolers, it is thus proposed that the oil cooler, the at least one compressed gas cooler and the at least one housing cooler are each set up to achieve cooling by means of a coolant flow consisting of a liquid coolant, in particular water. Each of said coolers therefore has at least one flow channel through which the coolant can flow. The coolers mentioned are therefore inherently coolers that use a coolant flow consisting of a liquid coolant for cooling, i.e. in particular coolers that are cooled by means of water or cooling water. During operation, a coolant flow thus flows through each cooler.

At least one housing cooler control means for individually controlling the cooling flow through the housing cooler such that individual actuation can take place is provided for the at least one housing cooler. Its control and thus cooling effect can thereby operate independently of the other coolers.

For this purpose, the compressor device has a cooling control which is designed to actuate the at least one housing cooler control means in such a way that the at least one cooling flow is controlled by the at least one housing cooler independently of the cooling flow through the oil cooler. The cooling control can be configured by the fact that it is implemented as a programmed control in a corresponding process computer and the process computer can be operatively connected to the at least one housing cooler control means. The housing cooler control means can be designed as a controllable valve or can have such a valve. The housing cooler control means may also comprise or be a pump, in particular an adjustable pump. It can be combined with a controllable valve.

In particular, it is provided that an individual actuatable control means is provided for each coolant flow in order to control each coolant flow individually, and therefore a cooling power is in each case individually controllable for the oil cooler, the at least one compressed gas cooler and the at least one housing cooler. It is also possible that, for example, one of the coolers, e.g. the compressed gas cooler, has two or more partial coolers, or is divided into two or more partial coolers, e.g. into an intermediate cooler and an aftercooler, and both partial coolers can each be controlled via a control means. For each of the two or more partial coolers, their respective coolant flow is therefore controllable. For this purpose, the partial coolers are connected in parallel to each other. The individual control of a respective coolant flow through each of the partial coolers can be configured in such a way that, in addition or exclusively, the distribution of an overall coolant flow to the partial coolers is controlled.

Two housing coolers, which may also be referred to as jacket coolers, can also be connected in series or in parallel. If they are connected in parallel, then this can be configured in such a way that a coolant flow is divided between said two housing coolers, with it being possible for only one control means to be provided for both housing coolers together. However, individual control of the cooling flow through the housing cooler is therefore also achievable because in this case, too, the control is undertaken independently of the other coolers, in particular independently of the oil cooler.

Preferably, a primary cooling circuit is provided for all of the coolers, in which the housing cooler or the housing coolers is or are connected completely or partially in a parallel connection to other coolers, in particular the oil cooler. However, this does not exclude the possibility that also, for example, two coolers, e.g. two housing coolers, which may therefore be configured as jacket coolers, are connected in series. Two such series-connected jacket coolers may also be considered to be a common housing cooler.

Each control means may be designed as a controllable valve, or as a controllable pump, or some control means are designed as a controllable valve and others as a controllable pump. Each control means can be considered to be an individual control means which can be actuated individually. This enables a constant adjustment of the coolant flow of each cooler and, as a result, each cooler can be operated at an operating point optimum for it. Each cooler can therefore be optimally operated. If, for example, the oil cooler requires increased cooling, its coolant flow can be increased without also increasing the coolant flow of the remaining coolers.

Here, it was recognized in particular that a previously conventional coupling of oil cooler and jacket cooler may be disadvantageous because different requirements are placed on the cooling of the housing and on the cooling of the oil, and therefore a decoupling is proposed.

It was also recognized that optimum cooling does not necessarily mean that cooling down as far as possible is carried out. The housing may expand or contract depending on temperature, which may have an effect on its mechanical function, especially on the size of gaps of elements moving relative to one another. It is particularly important that at least one gap between compressor housing and rotors and/or between rotors is kept within an optimum range. Excessive cooling of the housing leads to a reduction in the gap and thus to contact between rotor and housing or between rotors, as a result of which the gap would be permanently enlarged. If there is too little cooling of the housing, an unnecessarily large gap arises between rotor and housing or between rotors, which would lead to internal backflows of the previously compressed gas.

For the oil cooler, it is important that the oil viscosity is kept within an optimum range via the oil temperature. If the oil is too cold, the power consumption increases; if the oil is too warm, the wear increases.

The cooling of the compressed air to an optimum value after the last compressor stage is also important. If there is too little cooling, damage to components may occur or the compressed air drying may not function adequately.

The proposed solution makes it possible to achieve low electrical power consumption and an optimum compressed air outlet temperature.

A high temperature in the overall coolant flow or total coolant flow is frequently desirable. The intention is then for as much heat as possible to thereby be transferred to the heating water, which can be linked with the overall coolant flow or total coolant flow or can use it in order, for example, to save fuel costs for the heating. However, the temperature level has to be raised accordingly for this purpose so that the cooling water can be used for heating purposes, which may if anything have a negative effect on cooling of the compressor, but may be useful if there is a corresponding demand for heat. The decoupled control of the individual coolers enables both to be taken into consideration.

According to one aspect, it is proposed that the cooling control is designed to actuate the at least one housing cooler control means in such a way that the at least one cooling flow through the at least one housing cooler is controlled independently of the at least one cooling flow through the at least one compressed gas cooler.

This means that a further decoupling of the housing cooler is provided here. As a result, the housing cooler can be coordinated even more specifically to the cooling of the housing and in particular can be oriented to an optimum gap width of the gap between rotor and housing.

According to one aspect, it is proposed that the cooling control is designed to ensure that a cooling flow is controlled individually, in particular by means of the housing cooler control means, only for the at least one housing cooler, while cooling flows for the oil cooler and the at least one compressed gas cooler are not controlled or are controlled only via a common control of an overall coolant flow.

It was particularly recognized here that a specific actuation of the housing cooler and thus precise cooling of the housing is important, whereas the other coolers or the other elements to be cooled are less susceptible to temperature fluctuations and therefore only require cooling with a simple control, or even operate adequately without control. They are then controlled only by control of the general cooling circuit. The construction of the entire cooling system can thus be kept to a minimum, while at the same time high cooling quality of the housing is maintained. Error sources are also avoided by such a simplified cooling circuit.

In particular, the housing cooling or jacket cooling can be operated at a lower temperature than the oil cooling. The housing cooling or jacket cooling can be operated independently of the oil cooling system.

According to one aspect, it is proposed that the compressor has at least one rotor for compressing the compressed gas and at least one compressor gap having a variable gap thickness is formed between the housing and the at least one rotor or between two rotors, and the cooling control is designed to actuate the at least one housing cooler control means in such a way that the gap thickness remains within a predeterminable range, and/or that the gap thickness follows a predeterminable desired gap thickness.

Thus, the housing cooling is controlled specifically such that the compressor gap, which has already been referred to above in simplified terms just as a gap, is as optimum as possible. Here, it was recognized that the decoupled actuation of the housing cooler can keep the gap thickness within ranges which are good for the operation of the compressor.

For this purpose, the gap thickness can be detected, or the control is based on empirical values, which can be recorded in preliminary tests.

However, since measuring the gap thickness while the operation is proceeding may be complicated and at least one additional sensor would be required, the gap thickness may also be controlled via other values. In particular, the gap thickness can be deduced from more easily measurable temperatures and on the basis of empirical values.

Orienting the cooling to the gap thickness is particularly important for dry-compressing compressors and/or screw compressors. It is therefore proposed that the compressor is a dry-compressing compressor and/or is a screw compressor. The screw compressor is a compressor which is designed to compress the gas, in particular the air to be compressed, by a movement of two intermeshing screws. As a result, in particular, a continuous compression process can also be carried out. A turbo compressor may also be used as the compressor.

According to one aspect, it is proposed that the cooling control is designed to ensure that the gap thickness of the compressor is detected and/or estimated, and the at least one housing cooler control means is controlled depending on the detected or estimated gap thickness.

In order to control the gap thickness of the compressor gap, it is therefore proposed according to this aspect that this gap thickness is detected, in particular measured, and is returned. The control would then be part of a closed loop and could also itself be referred to as a closed-loop control.

A corresponding sensor can be used for the detection. Although this is associated with corresponding costs, the gap thickness can be detected with a high degree of accuracy.

For detection of the gap thickness, it is also possible to determine the gap thickness by means of a state observer. For this purpose, the state observer can use an input temperature of a gas which is flowing into a compressor stage and is to be compressed and its volume flow as an input variable and can use an outlet temperature of the gas that is at least partially compressed in the compressor stage as an output variable. The gap thickness is then a state of the state observer and a comparison between the outlet temperature of the state observer and a detected, corresponding outlet temperature can be used to adjust the states of the state observer or its model. It is also possible to simulate relationships using a model calculation and to compare the temperatures calculated in this way with the measured temperatures and thus to deduce the gap thickness.

According to one aspect, it is proposed that at least one outlet temperature of the gas that is completely or partially compressed to form a compressed gas is detected when said gas exits from the at least one compressor stage, a default temperature value for the outlet temperature, at which an optimum gap thickness should be expected, is determined, the default temperature value being determined in particular as the operation is proceeding, and the at least one housing cooler control means is controlled in such a way that the outlet temperature follows the default temperature value, in particular the outlet temperature is adjusted to the default temperature value as the desired temperature.

Here, it was recognized in particular that the temperature of the gas that is completely or partially compressed to form compressed gas, when said gas exits from the at least one compressor stage, which is referred to here as the outlet temperature, allows a fairly accurate statement about the gap thickness. Relationships between outlet temperature and gap thickness can be recorded in preliminary tests. The default value can generally be selected as the value at which the optimum gap thickness should be expected. If the outlet temperature is therefore adjusted to the default value, it should be expected that the gap thickness will have approximately its optimum value.

It is therefore also proposed to check a housing size or to provide cooling such that the housing size remains constant. This is particularly important for the gap thickness and can be reduced to the consideration of the gap thickness. It was recognized that it is also possible to detect the housing size or the gap thickness indirectly via the outlet temperature. In the control controlling the cooling, with a correct gap between rotors and between rotors and housing, the theoretical outlet temperature is compared with a detected temperature and the cooling is controlled depending thereon. With a correct, i.e. optimum, gap thickness between rotors and between rotors and housing, the theoretical outlet temperature can be taken into consideration as the default temperature. Particularly for screw compressors, especially in the case of dry-running screw compressors, the gap thickness should be particularly precisely maintained. If possible, the gap thickness should be reduced to zero μm, in particular permanently to zero μm.

However, it was also recognized that a relationship between optimum gap thickness and outlet temperature may depend on other variables, particularly on the outside temperature and a throughput of compressed gas. Therefore, according to one aspect, it is proposed to determine the default value as operation is proceeding. In particular, it is proposed to determine the default value depending on a coolant temperature available over the course of a year and/or an air intake temperature. Preferably, it is proposed to determine the default value depending on an outside temperature and/or on a throughput of compressed gas.

According to one aspect, a compressor device is proposed, which is characterized in that the cooling control is designed to ensure that the at least one housing cooler control means is controlled depending on at least one coolant temperature. This enables the housing cooling to be specifically controlled because the coolant temperature in particular can depend on the result of the cooling by means of the housing cooling. A closed-loop control may therefore also be assumed. Preferably, a desired value is specified for the coolant temperature. This also allows the coolant to be controlled to a desired temperature.

In particular, it is proposed that the cooling control is designed to ensure that the at least one housing cooler control means is controlled depending on a temperature from the list comprising

- a coolant temperature detected at a coolant outlet of the housing cooler, and
- a coolant temperature detected downstream of the housing cooler.

These temperatures best reflect the cooling power of the housing cooler, and the housing cooler can best influence these temperatures.

According to one aspect, a compressor device is proposed having a compressor for compressing a gas for generating compressed gas, in particular compressed air, and a cooling device. The cooling device comprises an oil cooler for cooling oil heated by the compressor, at least one compressed gas cooler for cooling the gas that is completely or partially compressed to form the compressed gas, and at least one housing cooler for cooling a housing or part of the housing of the compressor.

In addition, the oil cooler, the at least one compressed gas cooler and the at least one housing cooler are each set up to achieve cooling by means of a coolant flow consisting of a liquid coolant, in particular water. In addition, the oil cooler and/or at least one of the housing coolers are/is connected in series to at least one of the compressed gas coolers such that a coolant flow flows successively through said series-connected coolers.

Thus, at least a partial series connection of a plurality of different coolers is provided. In particular, the series connection of oil cooler and compressed gas cooler is proposed. The effect which can be achieved by the series connection is that the coolant obtains a high return temperature, and therefore a higher water outlet temperature can be achieved in the overall coolant flow. This enables the generated waste heat to be better used. At the same time, the jacket cooling and the oil cooler can be sufficiently cooled even at a high water inlet temperature.

With the proposed series connection, oil cooler and housing cooler can nevertheless be connected in parallel to each other, thus continuing to ensure that the housing cooler can be controlled independently of the oil cooler.

According to one aspect, it is proposed that the coolant flow flowing through said series-connected coolers first of all flows through the oil cooler, and then flows through the at least one compressed gas cooler such that a coolant having a lower temperature flows through the oil cooler than through the at least one compressed gas cooler.

This sequence in particular allows a high outlet temperature to be achieved since the coolant in the compressed gas cooler is still raised to a temperature that would not be achievable by the oil cooler.

According to one aspect, it is proposed that a cooling circuit is provided, for making the coolant available at a cooling circuit inlet and for withdrawing the coolant heated by the coolers at a cooling circuit outlet, in order to cool down the heated coolant or to supply same for a further use, in particular in order to use heat of the coolant, and that the compressor device has a cooling control. The cooling control is designed to control the compressor device in such a way that the coolant at the cooling circuit outlet has a temperature of 85-95° C., in particular 90° C. to 95° C.

For this purpose, a corresponding control program, which carries out corresponding method steps, can be executed in the cooling control. In addition, such a cooling control is connected to corresponding control means of the coolers, in particular valves, so that the control means can be actuated by the cooling control. A connection to at least one pump for driving an overall cooling flow can also be provided.

To control the temperature of the coolant at the cooling circuit outlet, said temperature can be measured and returned, and therefore the cooling control can be integrated in a closed loop or forms a closed-loop control.

The temperature of 85-95° C., in particular 90° C. to 95° C., can be considered to be a high temperature and further references, also with regard to other aspects, to high temperatures can be specified by these temperature values. Specifically, it was recognized that the temperature of 95° C. is high, but still below the temperature of boiling water under atmospheric pressure. It is also possible to keep to a limit of 110° C. which is possibly more relevant since the cooling water in a compressor device is usually under pressure, and therefore it evaporates only at a higher temperature. It should also be noted that other regulations may apply from 110° C. The temperatures mentioned are therefore provided particularly for cooling water as a coolant.

According to one aspect, it is proposed that the compressor device is constructed in such a way that the coolant first flows through the oil cooler and then flows through at least one of the at least one or more housing coolers.

The coolant can therefore be heated first in the oil cooler and then heated further in the housing cooler in order thereby to achieve a high temperature of the coolant at the cooling circuit outlet.

The housing cooler may consist of a plurality of housing coolers which can be connected in parallel or in series to one another. Further heating of the coolant in the housing cooler can be undertaken in both variants and can achieve the described effect.

According to one aspect, it is proposed that a plurality of compressed gas coolers are provided and that the compressor device is constructed in such a way that the coolant, after flowing through the oil cooler, flows through the plurality of compressed gas coolers, which are in particular connected in parallel such that the coolant flows in parallel through said plurality of compressed gas coolers.

Thus, the compressed gas coolers continue to heat the coolant after it has already been heated in the oil cooler. The effect which can be achieved by means of the parallel connection of the compressed gas coolers, which can each be designed as heat exchangers or can contain heat exchangers, is that both heat exchangers obtain the same cool water inlet temperature and, in the counterflow, i.e. in the compressed gas flow, which flows through the respective heat exchanger, can cool the compressed air to close to the water inlet temperature.

Since the compressed air inlet temperature is typically significantly above 100° C., especially in the range of about 120° C. to 250° C., the water, i.e. the cooling water, can be heated if required to the desired temperature with both compressed gas coolers.

According to one aspect, a compressor device is characterized in that a plurality or the plurality of compressed gas coolers are divided into a plurality of compressed gas cooler groups, wherein compressed gas coolers in in each case one compressed gas cooler group are connected in parallel to one another, and the compressed gas cooler groups are connected in series to one another. For this purpose, it can be particularly provided that a first and a second compressed gas cooler are connected in parallel to each other, and are connected in series to a third and fourth compressed gas cooler, which are connected in parallel to each other.

Thus, it can be achieved that the compressed gas coolers, which are designed in particular as heat exchangers, and this may be provided for all compressed gas coolers of all aspects, receive the coolant with the same water inlet temperature in a parallel connection. In the counterflow, they can cool the compressed air to close to the water inlet temperature.

Compressed gas coolers of a later or second compressed gas cooler group continue to heat the coolant after it has already been heated in the compressed gas coolers of the first compressed gas cooler group.

According to the invention, a method for controlling a compressor device is also proposed, wherein the compressor device has a compressor, in particular screw compressor, for compressing a gas for generating compressed gas, in particular compressed air, wherein the compressor has at least one compressor stage. The compressor device also has a cooling device. The cooling device comprises an oil cooler for cooling oil heated by the compressor, at least one compressed gas cooler for cooling the gas that is completely or partially compressed to form the compressed gas, and at least one housing cooler for cooling a housing or part of the housing of the compressor.

The oil cooler, the at least one compressed gas cooler and the at least one housing cooler are each set up to achieve cooling by means of a coolant flow consisting of a liquid coolant, in particular water. At least one housing cooler control means for individually controlling the cooling flow through the housing cooler is provided for the at least one housing cooler, and the compressor device has a cooling control. The cooling control actuates the at least one housing cooler control means in such a way that the at least one cooling flow through the at least one housing cooler is controlled independently of the cooling flow through the oil cooler.

In particular, it is proposed that the method operates in the way as has been described in conjunction with the compressor device. In particular, the method operates in the way as has been described for the compressor device or corresponding control, which are both designed to carry out a corresponding method or method steps. In particular, the following methods or method parts are proposed, the implementation and advantageous effects of which have also been described above in conjunction with aspects regarding the compressor device.

According to one aspect, a method is proposed in which the cooling control controls a cooling flow individually, in particular by means of the housing cooler control means, only for the at least one housing cooler while cooling flows for the oil cooler and the at least one compressed gas cooler are not controlled or are controlled only via a common control of an overall coolant flow.

According to one aspect, it is proposed that the compressor has at least one rotor for compressing the compressed gas and at least one compressor gap having a variable gap thickness is formed between the housing and the at least one rotor, and the cooling control actuates the at least one housing cooler control means in such a way that the gap thickness remains within a predeterminable range, and/or that the gap thickness follows a predeterminable desired gap thickness.

According to one aspect, it is proposed that using the cooling control, the gap thickness of the compressor is detected and/or estimated, and that the at least one housing cooler control means is controlled depending on the detected or estimated gap thickness.

According to one aspect, it is proposed that, using the cooling control at least one outlet temperature of the gas that is completely or partially compressed to form a compressed gas is detected when said gas exits from the at least one compressor stage, a default temperature value for the outlet temperature, at which an optimum gap thickness should be expected, is determined, the default temperature value being determined in particular as the operation is proceeding, and the at least one housing cooler control means is controlled in such a way that the outlet temperature follows the default temperature value, in particular that the outlet temperature is adjusted to the default temperature value as the desired temperature.

In the following, the invention will be explained in more detail using exemplary embodiments with reference to the accompanying figures.

FIG. 1 shows a compressor device according to the prior art in a schematic illustration.

FIGS. 2 and 3 each show a compressor device according to an embodiment of the invention in a schematic illustration.

Figure 1:
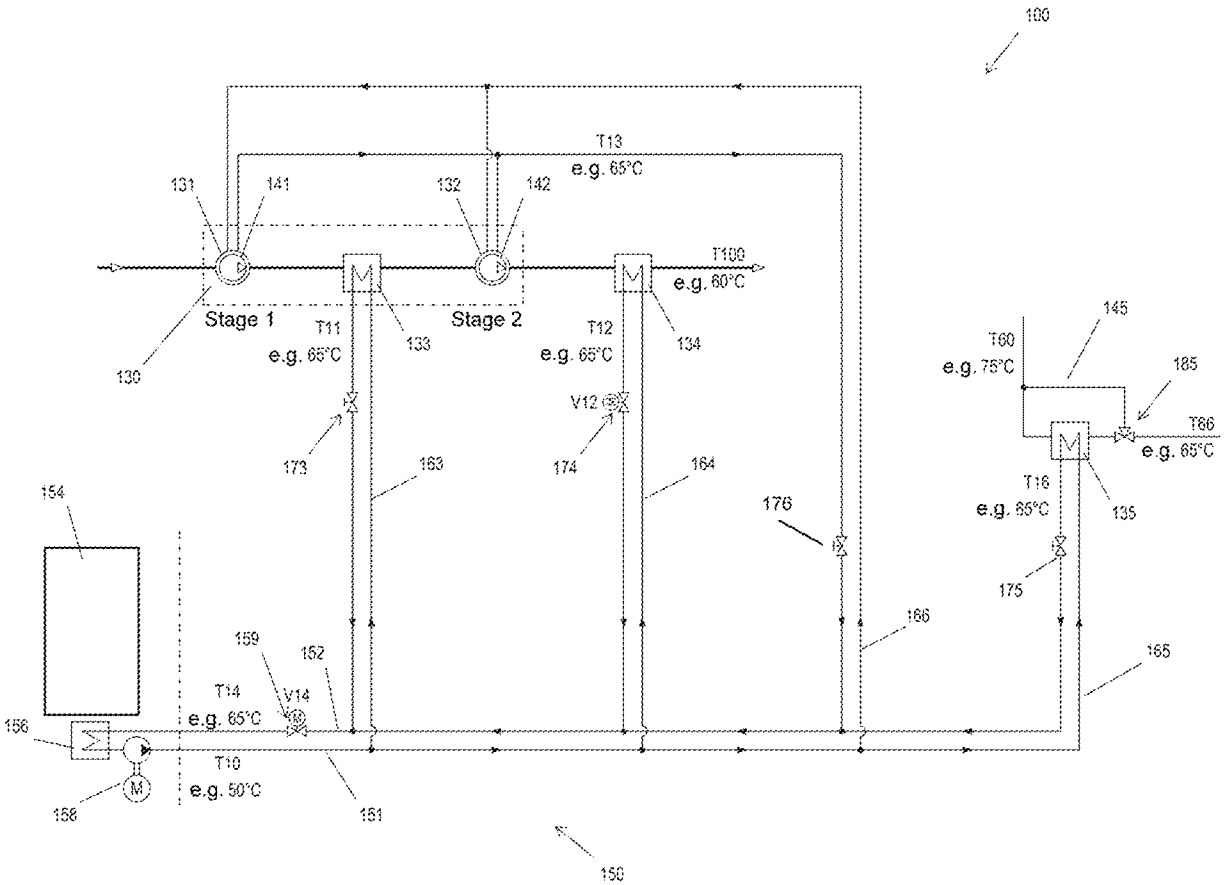

FIG. 1 shows a compressor device 100 having a compressor 130 with a first and second compressor stage 131 and 132, respectively. The compressor 130 and also the other elements are illustrated schematically.

Furthermore, an intermediate cooler 133 and an aftercooler 134, which may also be referred to as compressed air intermediate cooler or compressed air aftercooler, are provided. The intermediate cooler is illustrated here as part of the compressor 130, since it is arranged between the first and second compressor stage, but it may also be designed as a separate element. Accordingly, the aftercooler 134, which is not illustrated as part of the compressor 130, may be part of the compressor in another configuration.

For the cooling of the first and second compressor stages 131, 132, a first and second jacket cooling system 141 and 142, respectively, are provided. The jacket cooling systems 141 and 142 are each integrated in the respective compressor stage 131 and 132.

In addition, an oil cooler 135 is provided. The oil cooler 135 is connected to an oil circuit 145 of the compressor 130. For the sake of clarity, the connection between oil circuit 145 and compressor 130 is not illustrated in the figure, and furthermore not in most of the other figures either.

For cooling the compressor device 100 overall, a primary cooling circuit 150 is provided with a coolant supply 151 and a coolant return 152. The coolers mentioned, namely the intermediate cooler 133, the aftercooler 134, the first and second jacket coolers 141, 142 and the oil cooler 135, are supplied via this primary cooling circuit with cold coolant, in the illustrated example namely with water, namely via the coolant supply 151. The water heated in this way by the coolers flows back via the coolant return 152 into a heat sink 154, which is only indicated in abstract form. The heat sink 154 may be, but no longer has to be, part of the compressor device 100. A primary heat exchanger 156 is provided in the heat sink or as a heat sink and a common coolant flow in the primary cooling circuit 150 can be achieved by a primary coolant pump 158.

The coolers mentioned, namely the intermediate cooler 133, the aftercooler 134, first and second jacket coolers 141, 142 and the oil cooler 135 are connected in parallel in the primary cooling circuit. This means that all of the coolers mentioned are supplied by coolant from the primary cooling circuit 150. For this purpose, the respective coolers are connected to the primary cooling circuit in parallel via an intermediate cooler line 163, an aftercooler line 164, a jacket cooler line 166 or an oil cooler line 165.

The jacket cooler line 166 thus initially supplies the first and second jacket coolers 141, 142. In the example according to FIG. 1, the first and second jacket coolers 141, 142 are connected in parallel.

Manually adjustable valves, namely a manual intermediate cooler valve 173, a manual jacket cooler valve 176 and a manual oil cooler valve 175, are provided for adjusting the coolant flows or their ratios to one another. In order to be able to better coordinate the intermediate cooler 133 and the aftercooler 134 with each other, an aftercooler control valve 174 is provided.

In addition, a primary control valve 159 which can control the return of the overall coolant in the coolant return is provided.

In addition, an oil bypass valve 185 which can be used to control the flow of the oil through the oil cooler 135 is also provided.

FIG. 1 thus shows a functioning cooling concept, with regard to which, however, improvements have still been identified. In particular, it has turned out that the individual coolers are at least partly not readily coordinated with one another and cool to differing degrees to one another. It was recognized that there is a need for improvements here in order to achieve good, uniform and thus efficient cooling for the compressor device 100. It was also recognized that there is a need for adjusted cooling for each cooler, which may also depend on the operating state of the compressor device, in particular its cooling device. In particular, a demand for adjusted cooling may be dependent on the final pressure, on the rotational speed, on the intake temperature, on the cooling water inlet temperature T10, and on a desired cooling water outlet temperature at the temperature measuring point T14. In particular, it may be dependent on a compressed air outlet temperature T100 and dependent on a desired oil temperature T60 or T66.

It should be noted that the compressor device 100 thus consists of the compressor 130 and the multiplicity of coolers mentioned and also including the primary cooling circuit, wherein the coolers mentioned, including the primary cooling circuit mentioned (possibly a further secondary cooling circuit), can be understood as meaning the cooling device of the compressor device.

The following disadvantages are particularly evident:

the distribution of the water volume flows to the parallel coolers have had to be set manually, but the distribution of the heat outputs and thus the water temperatures may fluctuate significantly depending on the operating point.

If the desired outlet temperature is higher at the temperature measuring point T14, the oil cooler and the jacket cooling system have to be cooled separately with cooling water, which can be undertaken via a secondary cooling system.

Due to various disturbance variables, there may be significant deviations between the individual outlet temperatures T11, T12, T13, T16.

The most common result is an ineffective use of the cooling water. Stage damage due to excessively cold cooling water is possible.

The following was also found to be detrimental.

The water outlet temperature was controlled via a common valve V14.

The oil temperature was controlled via a bypass to the oil cooler. The oil cooler usually received an unnecessarily large amount of water so that it can still cool sufficiently even in the worst case.

The aftercooler usually received an unnecessarily large amount of water so that it can still cool sufficiently even in the worst case. Only the temperatures T11=T12 were adjusted via the valve V12 in order to be able to compensate for different heat outputs in the aftercooler.

The jacket cooling system usually receives too little water to be able to reach the desired outlet temperature T14—but sometimes too much and excessively cold water, which may lead to damage to the stages.

Intermediate cooling receives only sufficient water to be able to reach the desired mixed outlet temperature T14.

If a component temporarily requires better cooling, V14 opens further so that all of the heat exchangers receive more water, but the desired water outlet temperature T14 is no longer achieved.

In FIG. 1 it can be particularly also recognized that the oil cooler 135, the jacket coolers 141 and 142, which may also be referred to as housing coolers, and the compressed gas coolers, namely the intermediate cooler 133 and the aftercooler 134, are all connected in parallel to one another. This construction has been tried and tested for cooling, but the coolers mentioned, because of the parallel connection, receive coolant which is always cool and which cannot be raised to very high temperatures in the respective cooler, as a result of which the temperature at the outlet to the heat exchanger of the primary cooling circuit 150 cannot become very high. As a typical value, the temperature can reach, for example, approximately 65° C. This means that it is not readily possible to use the waste heat.

Figure 2:
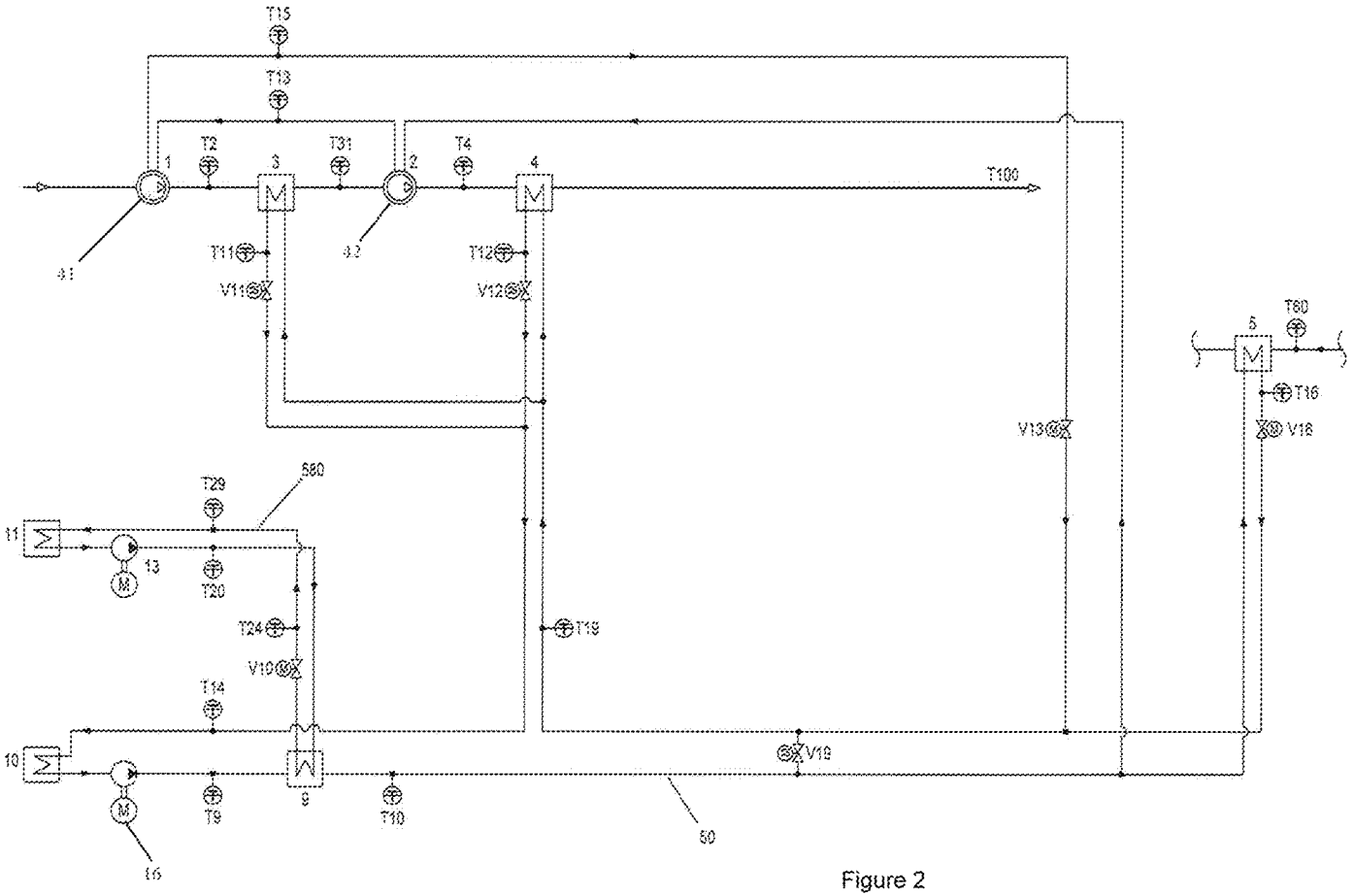

FIG. 2 shows a compressor device 300 according to one refinement. This compressor device 300, very similarly to the compressor device 100 of FIG. 1, has a compressor 30 with a first and second compressor stage 1, 2 having a first and second jacket cooler 41, 42. In the embodiment shown, the first and second jacket coolers 41, 42 are connected in series to each other.

In addition, an intermediate cooler 3 and an aftercooler 4 which both cool compressed gas are provided. The intermediate cooler 3 cools a partially compressed gas, while the aftercooler 4 cools the fully compressed gas.

An oil cooler 5 which cools oil that flows through the compressor 30 is also provided.

All of the above coolers 3, 4, 5, 41 and 42 are connected to a primary cooling circuit 50, which therefore supplies them with coolant. For operating the primary cooling circuit, a primary heat exchanger 10 and a primary coolant pump 12 are provided, similarly to that shown in FIG. 1. The primary heat exchanger 10 and/or the primary coolant pump 12 may each form part of the compressor device, or not.

Each of the cooling elements connected to the primary cooling circuit 50 can be controlled, not manually, via a dedicated, namely individual, control means, in particular via actuatable control means. For this purpose, control valves V11, V12, V13 and V16 are in each case arranged in a coolant line connected in parallel to the primary cooling circuit, in order to control a coolant flow through the respective cooling element. In this and all the other embodiments, control valves may be referred to in simplified form as valves. The first and second jacket coolers 41 and 42 can be actuated via the control valve V13. Alternatively, separate valves would also be possible if the first and second jacket coolers 41 and 42 were connected in parallel to each other.

The cooling elements mentioned, i.e. intermediate cooler 3, aftercooler 4, oil cooler 5 and the first and second jacket coolers 41 and 42, can thus be individually actuated. In particular, the jacket coolers 41 and 42 can be controlled independently of the oil cooler via the valve V13.

In particular, provision is made also to detect and to take into consideration temperatures of the coolant, i.e. the cooling water, in order to control the respective cooling elements or to control the control valves V11 to V13 and V16. Corresponding temperature measuring points T2, T31, T4 and T9 to T16, T19, T20, T29 and T60 are provided for this purpose. The cooling systems can thereby be controlled depending on these temperatures.

In particular, the first and/or second jacket cooling system can be controlled depending on an outlet temperature of the compressed gas at the outlet from the first and/or second compressor stage 1 or 2, i.e. depending on the compressed gas temperature detected at the temperature measuring point T2 or T4. For this purpose, the jacket cooling systems 41 and 42 can be controlled jointly via the valve V13, or individually, if they are connected in parallel to each other. The valve V13, or two corresponding valves, in the case of a parallel connection, may be referred to as housing cooler control means. This allows the housing cooling to be controlled independently of the oil cooler. As a result, the specific temperature-dependent control of the jacket cooling is possible. This makes it possible for the control of the jacket cooling system to be specifically directed to controlling a gap thickness between rotors or rotor and housing.

The oil cooler can, for its part, be controlled by the valve V16, independently of the housing cooling.

An oil temperature is detected at the temperature measuring point T60. Further temperatures may also be detected, such as an outlet temperature T100 as the outlet temperature from the compressor device.

Preferably, all of these temperatures can be incorporated in the control of the cooling and thus in the control of the control valves V10 to V13, V16 and V19. However, it is not necessary to take all of the temperatures into consideration. Preferably, at least one temperature is taken into consideration.

The compressor device according to FIG. 2 thus has a compressed air intermediate cooler 3, a compressed air aftercooler 4, oil cooler 5 and compressor stages 1, 2 with a jacket cooling system 41, 42.

In this exemplary embodiment, there is a cooling water circuit 50, which has a heat exchanger 10, e.g. for recovering heat. The heat exchanger 10 may be used for the waste heat utilization, but use may also be made of a cooling system which is not used for the waste heat utilization. However, the benefit is particularly great in combination with the waste heat utilization.

In addition, a secondary cooling circuit 580 is provided for cooling the overall coolant flow of the primary cooling circuit 50. For this purpose, a link is provided via the primary-secondary heat exchanger 9.

The secondary cooling circuit 580 can output heat again via a secondary heat exchanger 11 and its coolant flow can be driven via a secondary coolant pump 13.

The secondary cooling circuit 580 can cool a coolant flow, in particular overall coolant flow, of the primary cooling circuit, and the primary-secondary heat exchanger 9 is provided for this purpose. For the actuation, the control valve V10 is also provided and is thus arranged in a coolant line of the primary-secondary heat exchanger 9. The actuation of the control valve V10 can be undertaken depending on a downstream temperature of the coolant leaving the primary-secondary heat exchanger 9. A temperature measuring point T10 is provided for this purpose. The temperature of the coolant flowing through the control valve V10 can be detected at the temperature measuring point T24.

The heat exchanger 9 is used if the water inlet temperature T9 into the compressor is excessively high, and therefore the heat exchangers cannot sufficiently cool the compressor, e.g. the oil. The inflowing water can then be cooled via the heat exchanger 9 to a desired, sufficiently low temperature T10.

A similar situation arises if less or no heat is required in the primary heat exchanger 10; in this case, the temperature T9 can approximately reach the temperature T14. Since the power input of the compressor decreases the lower the temperature T31 is and if the temperature T13 (see FIG. 2) is sufficiently or even optimally low, an attempt is made, in the event of a low heat requirement, to keep the temperature T10 as low as possible.

The heat exchanger 9 is particularly proposed for the case in which the water inlet temperature at the temperature measuring point T9 in the compressor is excessively high, and therefore the heat exchangers cannot sufficiently cool the compressor, e.g. the oil. The inflowing water can then be cooled via the heat exchanger 9 to a desired, sufficiently low temperature T10.

A similar situation arises if less or no heat is required in the heat exchanger 10; in this case, the temperature at T9 can approximately reach the temperature at T14. Since the power input of the compressor decreases the lower the temperature at T31 is and if the temperature at T13 is sufficiently/optimally low, an attempt is made, in the event of a low heat requirement, to keep the temperature at T10 as low as possible.

The four control valves V11, V12, V13 and V16 allow the water volume flow through the components 3, 4, 5, 1, 2 and 41, 42 to be adjusted individually and in optimized fashion.

A closed-loop control of the (mixed) water outlet temperature T14 of the compressor is possible via the above-mentioned valves V11, V12, V13, V16.

In particular, it is proposed that the temperatures after the first and second compressor stages, thus at the measuring points T11 and T12 according to the figures, are incorporated in order to prevent steam bubble formation and associated hazards.

It is proposed that at least one oil temperature, e.g. at the measuring point T60, should be incorporated in the control in order to control the water volume flow through the oil cooler. Alternatively, a component temperature, e.g. a bearing outer ring temperature, could be used.

Particularly preferably, it is proposed to incorporate an inlet temperature of the compressed gas into the second compressor stage, thus particularly at the measuring point T31, into the control, in order to protect the second compressor stage from excess temperature, and in particular to increase the efficiency.

With the construction of FIG. 2, a high temperature of the coolant at the cooling circuit outlet, namely at the outlet to the heat exchanger 10 and thus at the temperature measuring point T14, can also be achieved. A temperature of 85-95° C., in particular 90° C. to 95° C., can be achieved. This can be achieved by means of the series connection of the first and second compressed gas coolers 3 and 4 with respect to the jacket coolers 41, 42 and the oil cooler 5. The first and second compressed gas coolers 3 and 4 thus receive coolant at a temperature which is higher than the temperature T10 so that they can further heat the coolant that has already been preheated in this way.

As a result, a higher temperature of the coolant can be achieved overall. This allows the waste heat in the coolant to be better used.

The embodiment of FIG. 2 provides a primary bypass control valve V19, which may also be referred to in simplified terms as a bypass valve V19, and via which some of the overall coolant flow of the primary cooling circuit 50 can be supplied to the intermediate cooler 3 and aftercooler 4 before the tapping point—according to one embodiment also after the tapping point—by the first and second jacket coolers 1, 2 and the oil cooler 5. Here, in particular, a series connection of the oil cooler 5 and the first and second jacket coolers 41, 42 with the two compressed gas coolers, that is, the intermediate cooler 3 and the aftercooler 4, is namely provided. The two compressed gas coolers thus receive heated coolant from the oil cooler 5 and the first and second jacket coolers 41, 42. However, coolant which is nevertheless cooler and has namely not yet passed through the oil cooler 5 and the first and second jacket coolers 41, 42 can be supplied to the two compressed gas coolers by means of the valve V19, as a result of which the volume flow to the oil cooler can be reduced. This can be used particularly during a cold start, as will also be explained below.

The series connection of the oil cooler 5 and the first and second jacket coolers 41, 42 to the two compressed gas coolers, that is, the intermediate cooler 3 and the aftercooler 4, is proposed as an optimized interconnection for waste heat utilization at a high temperature level. The oil cooler 5 and the jacket cooling system 41, 42 here receive a maximum volume flow with primary water that has not yet been preheated and is still at the temperature T10.

The primary bypass control valve V19 is particularly used during the cold start. If the oil has not yet reached the operating temperature, the primary bypass control valve V19 is open. In the case of a coolant which is still cold, i.e. cold water, particularly at low temperatures at the temperature measuring points T10, T13, T15, the control valve V13 can also be closed. However, it was recognized that the valves V11 and V12 should already very rapidly control an adequate water flow after the cold start. It is therefore proposed to open the valve V19 during the cold start. During operation, when the cold start process is complete, it is proposed to somewhat close the bypass valve V19 again so that the oil cooler and the jacket cooling system can receive a relatively high cooling water volume flow.

A predetermined water outlet temperature, i.e. desired temperature, at the measuring point T14 can result only from a mixture of the partial coolant flows with the temperatures T11 and T12. Higher outlet temperatures can be achieved with these two coolers. In particular, a high outlet temperature T14 can thereby be achieved.

It has been recognized that the following advantages arise.

The waste heat from the oil cooler and from the jacket cooling system can be supplied for waste heat utilization, even at water temperatures, i.e. coolant temperatures, at which this is not yet possible.

A higher desired temperature for the outlet temperature T14 can be achieved since only the partial coolants are mixed with the temperatures T11 and T12 or at the measuring points T11 and T12, thus resulting in a mixing temperature that is not mixed to a lower temperature by coolant with the temperatures T16 and T15. Temperatures of 85-95° C., in particular 90° C. to 95° C., can be achieved as the outlet temperature T14 of the coolant of the primary cooling circuit.

A water system can thus achieve high temperatures and simultaneously high outputs, which would otherwise require a hot water system.

Below is a summary of some essential aspects of the embodiment according to FIG. 2.

There are two cooling water circuits 50, 5800.

The coolers 3, 4, 5 and the jacket cooling system of the stages 1, 2 are located in the primary circuit 50. First of all, there is a parallel connection of the oil cooler 5 and the jacket cooling system of the stages 1, 2. The intermediate cooler 3 and the aftercooler 4 are then connected in series. They are also connected in parallel to each other.

The secondary circuit 580 cools the primary circuit 50 here as required.

This interconnection variant affords particular advantages in the recovery of heat via the heat exchanger 10, which may also be referred to as waste heat utilization.

The following advantages arise.

Higher heat recovery capacity is possible and possibly less/no cooling water is required.

A closed-loop control to a higher water outlet temperature T14 is possible, i.e. the possibility of specifying a higher desired value for this water outlet temperature T14, namely higher than previously, e.g. 90° C. . . . 95° C. instead of ~80° or 85° C., as previously.

The following further advantages arise.

An optimized closed-loop control of the mixed water outlet temperature T14 with separate closed-loop control of the volume flow per heat source is possible.

The user can predetermine a water outlet temperature T14.

Figure 3:
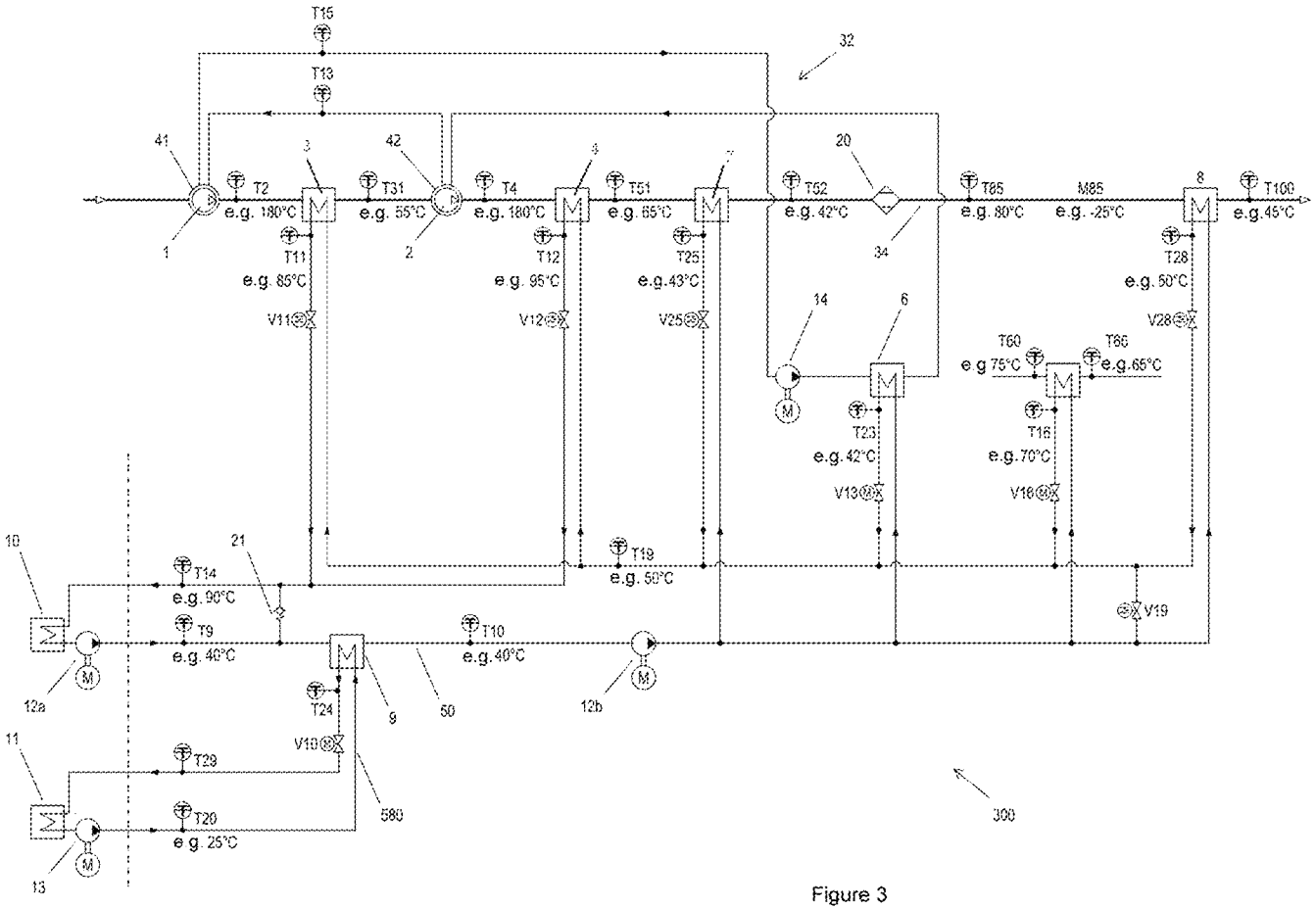

The oil cooler receives only as much water as necessary to reach the optimum oil temperature. FIG. 3 below describes another embodiment which, however, for the sake of better clarity, uses partially identical reference signs to the embodiment of FIG. 2 to better show relationships. However, this does not require the elements to actually be identical.

FIG. 3 shows an embodiment of a compressor device 300 which provides a jacket cooler heat exchanger 6 for the first and second jacket coolers 41, 42. Jacket coolers 41, 42 can also be connected in series here. A coolant flow through the jacket coolers 41, 42 is driven by a jacket cooler pump 14 and thus drives a dedicated cooling circuit, which may be referred to as a compressor cooling circuit 32, since the coolant flows through corresponding jacket regions in the first and second compressors 1, 2. The jacket cooler pump 14 is thus a cooling water pump for the compressor cooling circuit 32. The compressor cooling circuit 32 or the coolant therein flows through the first and second jacket coolers 41, 42 and is guided through the heat exchanger 6, namely through a primary side of the jacket cooler heat exchanger 6. Coolant flows out of the primary cooling circuit 50 through the secondary side of the jacket cooler heat exchanger 6. The corresponding coolant flow from the primary cooling circuit 50 through the jacket cooler heat exchanger 6 is controlled by the control valve V13.

Temperatures at the temperature measuring points T9, T10, T11, T12, T14, T16, T19, T20, T23, T24, T28, T29, T31, T51, T52, T85, T100 are recorded as the relevant temperatures. In addition, the pressure dew point M85 after the adsorption dryer 20 can also be recorded.

Preferably, the valve V13 is actuated depending on the temperatures of the coolant leaving the first and/or second jacket cooler 41, 42.

Temperatures at measuring points Txx, where "xx" is a placeholder for the respective number of the temperature or measuring point, may also be referred to below and above in simplified form and synonymously as temperatures Txx.

During the cold start, V13 remains closed, and therefore there is then no coolant flow at T23. At the temperature measuring point T23, there is therefore then no increasing temperature either. When the temperatures of the coolant leaving the first and/or second jacket cooler 41, 42 increase, the valve V13 is opened by the control, which may also be referred to as "adjusted to open". Only then could the temperature at the measuring point T23 be used for the closed-loop control.

The control valve V13 may be referred to as a jacket cooler control valve and it controls the coolant flow through the jacket cooler heat exchanger 6. In other refinements, it can also control the coolant volume flow for the jacket coolers 41, 42. The valve V13 controls the temperatures of the coolant leaving the first and/or second jacket cooler 41, 42.

FIG. 3 also has a second and third aftercooler 7, 8, which may also be referred to as the second and third compressed air aftercooler and here are particularly in the form of heat exchangers. They are arranged in a compressed gas line 34, namely downstream of the compressed gas after the aftercooler 4 or compressed gas aftercooler 4. This allows additional cooling of the compressed gas to be achieved. The third compressed air aftercooler or compressed gas aftercooler can also be synonymously referred to as a dryer aftercooler.

It is particularly preferred, as the embodiment of FIG. 3 also shows, to use a dryer for the compressed gas, in particular an adsorption dryer 20, which is integrated in the compressed gas line 34. In the case of a refrigerant dryer, an additional aftercooler 7 also makes sense in order to be used to adjust the dew point and the outlet temperature. However, the third compressed air aftercooler 8 makes less sense in the case of the refrigerant dryer as illustrated. In the case of the refrigerant dryer, the third compressed air aftercooler 8 could be used instead to heat up the compressed air. Therefore, in particular the use of an adsorption dryer is proposed here. In the case of the adsorption dryer, the third compressed air aftercooler 8 is used particularly for cooling the compressed air.

Here, it is particularly proposed that the compressed gas dryer 20 is arranged in the flow direction of the compressed gas after the second aftercooler 7 and before the third aftercooler 8.

A control valve V25 or V28 is in each case provided for controlling a coolant flow both through the second aftercooler 7 and the third aftercooler 8. Thus, even the second and third aftercoolers 7, 8 can be controlled independently of each other.

In addition, a temperature measuring point T25 or T28 is in each case provided and assigned to the second or third aftercooler 7, 8 and thus to the corresponding control valve V25 or V28.

It was particularly recognized here that the second aftercooler 7 can be used to support the dryer and thus influence the pressure dew point after the dryer. However, this also reduces the outlet temperature from the dryer, which is sometimes desirable, but is sometimes also undesirable.

With the heat exchanger, i.e. aftercooler after the dryer, the compressed air can be brought to the optimum temperature for the downstream use. In the case of an adsorption dryer, the air at the outlet may be significantly warmer than at the inlet, and therefore further cooling may be necessary here.

The control valve V25, which controls the coolant flow through the second aftercooler 7, can control this coolant flow depending on the temperature detected by the temperature measuring point T25. However, the valve V25 is preferably used to adjust the air outlet temperature T52. The desired value for this temperature T52 is produced from the desired pressure dew point after the dryer by means of a control cascade, in the case of systems with a dryer. For systems without a dryer, the desired value for the temperature T52 is produced from the desired value for the temperature T100, which can be predetermined externally.

A closed-loop control according to the temperature T25 or according to a temperature difference T25-T20 is also possible, according to a further refinement.

The control valve V25 therefore controls the coolant flow from the second aftercooler 7 depending on the outlet temperature of the compressed air at the temperature measuring point T52.

It is also provided that the control valve V28, which controls the coolant flow through the third aftercooler 8, adjusts the compressed air outlet temperature T100. A closed-loop control according to the temperature T28 or the differential temperature T28-T20 is provided, according to an alternative refinement.

This can therefore be undertaken depending on the temperature of the temperature measuring point T28; i.e. it is possible to control the coolant flow depending on the coolant temperature at the output of the third aftercooler 8.

In the embodiment shown, it is additionally provided that a secondary cooling circuit 580 cools a coolant flow, in particular overall coolant flow, of the primary cooling circuit 50, and a corresponding primary-secondary heat exchanger 9 is provided for this purpose. For the actuation, the control valve V10 is also provided and is thus arranged in a coolant line, and therefore also in a coolant flow, namely in the secondary cooling circuit of the primary-secondary heat exchanger 9. The actuation of the control valve V10 can be undertaken depending on a downstream temperature of the coolant leaving the primary-secondary heat exchanger 9. A temperature measuring point T10 is provided for this purpose. The temperature of the coolant flowing through the control valve V10 can be detected at the temperature measuring point T24.

It is proposed to split the primary coolant pump 12 according to FIG. 2 in the embodiment shown in FIG. 3, that is to say, instead to provide two primary coolant pumps 12*a* and 12*b*, namely one before and the other after the primary-secondary heat exchanger 9. In addition, a primary circuit bypass 21 may be provided, via which some of the overall coolant flow of the primary cooling circuit 50 flows past the primary heat exchanger 10. The internal pump 12*b*, in conjunction with the bypass 21 and the heat exchanger 9, can maintain the operation of the compressor and thus the compressed air supply, even if the external heat sink 10 and/or the pump 12*a* are/is not available. This may be the case, for example, during maintenance work or conversion measures, or even during seasonal heat requirements.

The external pump 12*a* is designed in particular for the external pressure losses, namely in the heat exchanger 10 and in pipelines and possibly other elements. The internal pump 12*b* can run at the same time for support purposes or else can just be on standby in the event of being required. It only switches on if the primary coolant pump 12*a* supplies no water or too little water, and the compressor would otherwise become too hot and would shut down.

In addition, a pressure dew point temperature measuring point M85 is provided after the drying device 20. Thus, the pressure dew point temperature is determined at the point and the cooling can be controlled depending thereon. In particular, it is proposed to control the second aftercooler 7 and/or the valve V25 depending on the pressure dew point temperature.

The valve V25 is highly effective here when the additional aftercooler 7 is present.

In addition, the valve V11 (open less to increase the temperature T31) and the valve V12 (open more to reduce the temperature T51) can improve the dew point M85.

A higher temperature T31 results in a higher regeneration temperature for the dryer, and therefore a lower dew point M85 can be achieved.

It was recognized that the valve V25 is most highly effective if the additional aftercooler 7 is present. In addition, the valve V11, by opening less to increase the temperature T31, and the valve V12, by opening more to reduce the temperature T51, can improve the dew point M85.

It was also recognized that a higher temperature T31 makes it possible to achieve a higher regeneration temperature for the dryer, in particular the adsorption dryer 20, such that a lower dew point M85 can be achieved.

In particular, the pressure dew point after the dryer is relevant. At the inlet of the dryer, the compressed air is usually 100% saturated. Therefore, the temperature and the pressure dew point are almost identical here, provided that the precipitated condensate has been separated and discharged as completely as possible before the dryer.

The temperature of the compressed gas at the inlet to the dryer is particularly important for the drying result.

If the condensate were not to be separated before the dryer, the drying result would be slightly worse. However, the compressor should be designed in such a way that the already precipitated condensate is already separated beforehand.

The condensate separators and drains were not illustrated in the figures partially for reasons of simplification.

The embodiment according to FIG. 3 is designed in such a way that the second aftercooler 7 and third aftercooler 8 are connected in a parallel circuit to the primary cooling circuit 50. A secondary cooling circuit 580, which is configured as in FIG. 2 and coupled to the primary cooling circuit 50, is also provided.

The intermediate cooler 3 and aftercooler 4, which may also be synonymously referred to in this and the other embodiments as the first aftercooler 4, similarly to the embodiment of FIG. 2, are not connected in a parallel connection to the primary cooling circuit 50, but in a series connection, in which the coolant is supplied to them from the primary cooling circuit 50 after the coolant has flowed through the other coolers. A primary bypass control valve V19, as shown in FIG. 2, is unnecessary here, since in particular a sufficient water volume flow always flows through the second aftercooler 7 together with the control valve V25, and therefore the intermediate cooler 3 and the aftercooler 4, which are connected in series downstream, can always receive a sufficient volume flow. It is nevertheless shown as a possible alternative by way of precaution. This primary bypass control valve V19 could be used when the valve V28 is closed because the temperature T100 is sufficiently low and the valve V25 is closed because the pressure dewpoint M85 is sufficiently low. The valve V19 then has to open such that in particular the heat exchanger 3 receives more and cooler water after the compressor or compressor stage 1, since this improves the efficiency of the compression.

However, this embodiment could be implemented with a primary bypass control valve V19 and heat exchanger control valve V25. It could be useful in a special case, if warmer compressed air were needed in winter. The valves V28 and V25, for the aftercooler, would then have to be closed to an extent such that, without having to open the primary bypass valve V19, not enough water could be supplied for the intermediate cooler and aftercooler.

The effect which can be achieved by the primary bypass control valve V19 is that some of the coolant which has not passed through the third aftercooler 8 is supplied to the intermediate cooler 3 and aftercooler 4. It is namely also provided that the intermediate cooler 3 and the aftercooler 4 are arranged or interconnected in the primary cooling circuit in a series connection, but are connected in parallel to each other. By means of this series connection, a higher cooling water temperature can be achieved by the intermediate coolers 3 and aftercoolers 4; in particular at the output of the primary cooling circuit 50, the outlet temperature of the cooling water at T14 can be particularly high.

With regard to the embodiments of FIGS. 2 and 3, the following should be noted. In these two embodiments, the intermediate cooler 3 and the aftercooler 4 are connected in series to the primary cooling circuit, with the primary bypass control valve V19 being ignored for the explanation below for the sake of simplicity. The intermediate cooler 3 and the aftercooler 4 thus together receive the full coolant flow, that is, the overall coolant flow of the primary cooling circuit 50, which has already passed through a cooler and is therefore heated in relation to the temperature T10, since this is necessitated by the series connection. This allows intermediate cooler 3 and aftercooler 4 to output a coolant with a comparatively high temperature.

For the embodiment of FIG. 3, and other embodiments, the following advantages arise:

maximum heat recovery, with sufficient heat dissipation, and operation without cooling water, are possible. It is therefore possible that the secondary cooling system 11 does not have to be used, but can be available in the event that less heat is required or the compressor requires better cooling.

A connected building heating system is proposed as one use for this. It can have the following effect. In winter, all the heat can be used via the heat exchanger 10. In summer, by contrast, less heat is required, but the heat nevertheless has to be dissipated. This is then undertaken via the primary-secondary heat exchanger 9, the secondary cooling system 11 and the valve V10.

Depending on the temperature requirement and alternative, about 10 . . . 30% more waste heat utilization may be possible. Maximum waste heat utilization is possible with a water inlet temperature higher by approx. 5K . . . 10K.

A very high water outlet temperature T14 is possible, particularly up to about ~95° C.

Sufficient jacket cooling and oil cooling with heating water at a high volume flow rate is possible, particularly via the primary water system with the inlet and outlet temperatures T10 and T14, respectively.

A sufficient dew point can be achieved since the aftercooler 7 receives a large volume flow of cool heating water.

If required, a low compressed air outlet temperature is possible since the aftercooler 8 receives cool heating water.

In order to control the compressor cooling circuit 32, which may also be referred to as a jacket cooling circuit, the control valve V13 and a jacket cooler pump 14 are provided. These form a possible variant for the jacket cooling circuit.

Furthermore, the temperatures T2 and T4 are shown in FIG. 3. Both may be, for example, 180° C. This is intended to illustrate that the high water outlet temperatures T11, T12 and T14 of e.g. 90° C. can therefore be easily achieved, which is not possible with the temperatures T16 and T23 shown in FIG. 1.

Figure 4:
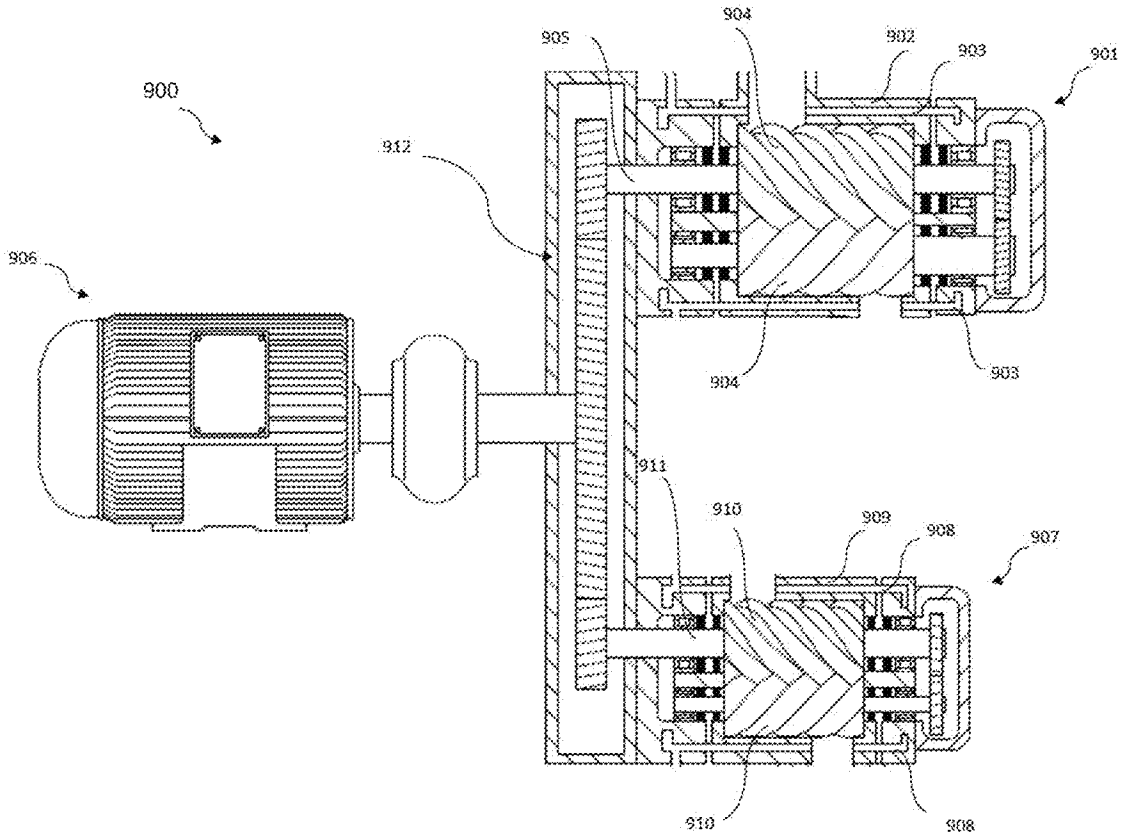
FIG. 4 shows a compressor with two compressor stages in a schematic, partially sectioned illustration.
Figure 5:
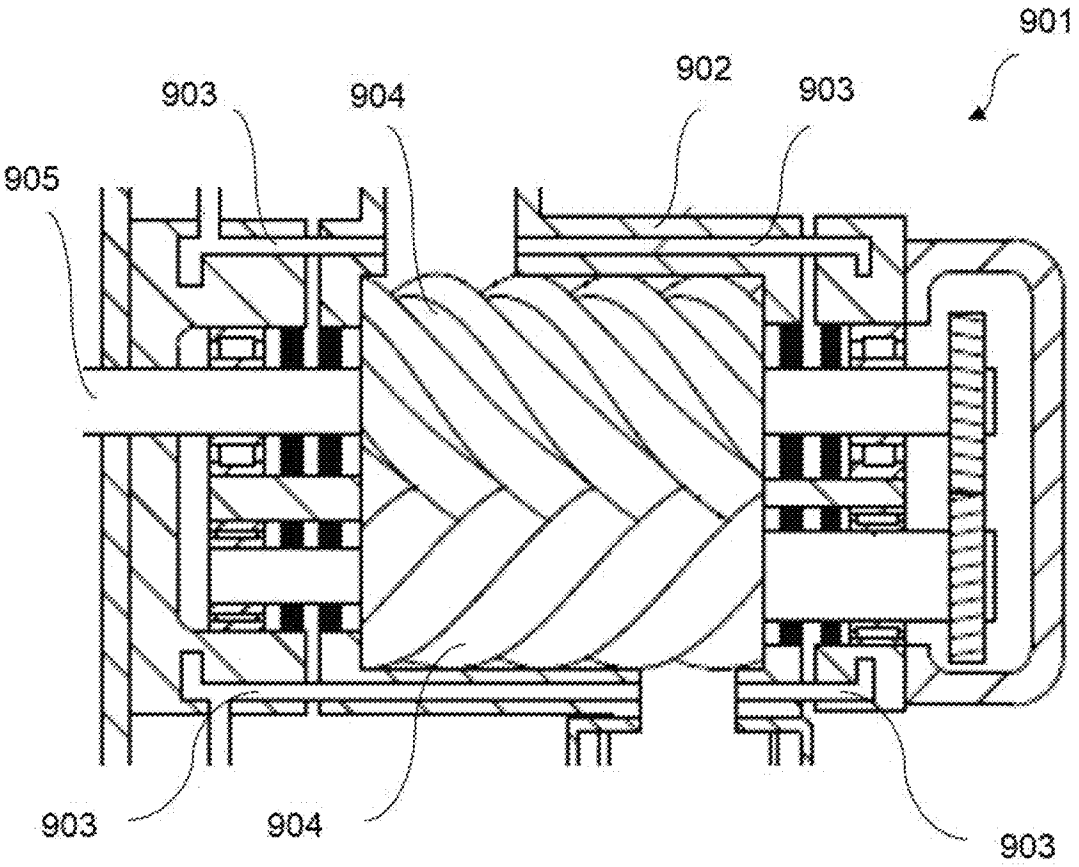
FIG. 5 shows a first compressor stage of the compressor of FIG. 4 in an enlarged illustration.

FIG. 4 shows a compressor 900 with a first and a second compressor stage 901 and 907, respectively, in a schematic, partially sectioned illustration. To this end, FIG. 5 shows a first compressor stage 901 in an enlarged illustration. Reference is made below to FIG. 4; to the extent that the first compressor stage is explained, reference is additionally made to FIG. 5.

FIG. 4 thus shows a dry-running screw compressor, which essentially forms the compressor 900. The first compressor stage 901 thus carries out compression of a first stage during operation. For this purpose, the first compressor stage 901 has a housing 902, and coolant channels 903 of a jacket cooling system, which are illustrated more clearly in particular in FIG. 5.

Compressor screws 904 which intermesh for the compressing are provided for compressing the compressed gas, particularly the compressed air. They are driven via a drive shaft 905 of the corresponding compressor stage. The second compressor stage 907, which further compresses the gas compressed in the first compressor stage, in particular compressed air, has a housing 909 with coolant channels 908 and compressor screws 910, which are driven via a drive shaft 911.

The two drive shafts 905 and 911 are driven via a common drive motor 906, and, for this purpose, a gearbox 912 is provided, which distributes the driving power from the drive motor to the two drive shafts 905 and 911, in order thereby to drive the compressor screws 904 and 910.

The two compressor stages 901 and 907 can be cooled via the jacket cooling, which is realized with the aid of the coolant channels 903 and 908. For this purpose, a cooling medium, in particular cooling water, flows through said coolant channels 903 and 908, and it can be controlled together or individually.

The invention claimed is:

1. A compressor system comprising a compressor for compressing a gas for generating a compressed gas, the compressor including a compressor stage, and a cooling system, the cooling system including an oil cooler for cooling oil heated by the compressor, a compressed gas cooler for cooling the gas that is completely or partially compressed to form the compressed gas, and a housing cooler for cooling a housing or part of the housing of the compressor, wherein the oil cooler, the compressed gas cooler and the housing cooler are each arranged to be cooled by a coolant flow comprising a liquid coolant, wherein a housing cooler control comprising a valve or a pump for individually controlling the coolant flow through the housing cooler is provided for the housing cooler, and the compressor system has a cooling control comprising a computer configured to actuate the housing cooler control, wherein the computer controls the housing cooler to control the coolant flow independently of the coolant flow through the oil cooler, wherein the compressor further includes a rotor for compressing the compressed gas and a compressor gap having a variable gap thickness formed between the housing and the rotor or between two rotors, and wherein the cooling control is arranged to actuate the housing cooler control to ensure the gap thickness remains within a predeterminable range, and/or that the gap thickness follows a predeterminable desired gap thickness.

2. The compressor system of claim 1, wherein the cooling control is arranged to actuate the housing cooler control to control the coolant flow through the housing cooler independently of the coolant flow through the compressed gas cooler.

3. The compressor system of claim 1, wherein the cooling control is arranged to control a cooling flow individually, via the housing cooler control, only for the housing cooler, while coolant flows for the oil cooler and the compressed gas cooler are not controlled or are controlled only via a common control of an overall coolant flow.

4. The compressor system according to claim 1, wherein the cooling control is arranged to detect and/or estimate the gap thickness of the compressor, and control the housing cooler control depending on the detected or estimated gap thickness.

5. The compressor system of claim 1, wherein the cooling control is arranged to detect an outlet temperature of the gas that is completely or partially compressed to form compressed gas when the gas exits from the compressor stage, determine a default temperature value for the outlet temperature, at which an optimum gap thickness should be expected, the default temperature value being determined during the coolant flow, and control the housing cooler control, wherein the housing cooler control is arranged to adjust the outlet temperature to the default temperature value as a desired temperature.

6. The compressor system of claim 1, wherein the cooling control is arranged to control the housing cooler control depending on a coolant temperature selected from a group consisting of a coolant temperature detected at a coolant outlet of the housing cooler, and a coolant temperature detected downstream of the housing cooler.

7. The compressor system of claim 1, wherein the oil cooler and/or the housing cooler are/is connected in series to the compressed gas cooler whereby a coolant flow flows successively through the oil cooler and/or the housing cooler.

8. The compressor system according to claim 7, wherein the compressor system is arranged such that the coolant flow flowing through the oil cooler and/or the housing cooler first flows through the oil cooler, and then flows through the compressed gas cooler, and wherein a coolant having a lower temperature flows through the oil cooler than through the compressed gas cooler.

9. The compressor system according to claim 1, further comprising a cooling circuit for making the coolant available at a cooling circuit inlet and for withdrawing the coolant heated by the coolers at a cooling circuit outlet, in order to cool down the heated coolant, and a cooling control which is arranged to control the compressor system, and wherein the coolant at the cooling circuit outlet has a temperature of 85-95° C., or 90° C. to 95° C.

10. The compressor system of claim 1, wherein a plurality of compressed gas coolers are provided, and the coolant, after flowing through the oil cooler, flows through the plurality of compressed gas coolers, which are connected in parallel whereby the coolant flows in parallel through the plurality of compressed gas coolers.

11. The compressor system of claim 10, wherein the plurality of compressed gas coolers are divided into a plurality of compressed gas cooler groups, and wherein each of the compressed gas coolers in each of the compressed gas cooler groups are connected in parallel to one another, and the compressed gas cooler groups are connected in series to one another, and wherein a first and a second compressed gas cooler are connected in parallel to each other, and the first and second compressed gas cooler are connected in series to a third and fourth compressed gas cooler, which are connected in parallel to each other.

12. A method for controlling a compressor system, the method comprising compressing a gas with a compressor, the compressor including a compressor stage, and cooling a cooling system with a liquid coolant, the cooling system including an oil cooler, a compressed gas cooler, and a housing cooler controlling a coolant flow of the liquid coolant through the housing cooler with a housing cooler control, the housing cooler control comprising a valve or a pump for individually controlling the coolant flow through the housing cooler, and controlling the coolant flow of the liquid coolant through the compressor system with a cooling control, the cooling control comprising a computer configured to actuate the housing cooler control to control the coolant flow through the housing cooler independently of the coolant flow through the oil cooler, wherein the compressor further comprises a rotor for compressing the compressed gas, and a compressor gap having a variable gap thickness formed between the housing and the rotor, and wherein the cooling control actuates the housing cooler control, wherein the gap thickness remains within a predeterminable range, and/or that the gap thickness follows a desirable range.

13. The method for controlling a compressor system of claim 12, wherein the oil cooler and/or the housing cooler are/is connected in series to the compressed gas cooler whereby a coolant flow flows successively through the oil cooler and/or the housing cooler.

14. The method for controlling a compressor system of claim 12, wherein the cooling control controls a cooling flow individually via the housing cooler control, only for the housing cooler while cooling flows for the oil cooler and the compressed gas cooler are not controlled or are controlled only via a common control of an overall coolant flow.

15. The method for controlling a compressor system of claim 12, wherein using the cooling control the gap thickness of the compressor is detected and/or estimated, and the housing cooler control is controlled depending on the detected or estimated gap thickness.

16. The method for controlling a compressor system of claim 12, wherein the cooling control detects an outlet temperature of the gas that is completely or partially compressed to form compressed gas when the gas exits from the compressor stage, determines a default temperature value for the outlet temperature, at which an optimum gap thickness should be expected, the default temperature value being determined during the coolant flow, and controls the housing cooler control, wherein the housing cooler control adjusts the outlet temperature to the default temperature value as a desired temperature.

* * * * *